US006196187B1

(12) United States Patent
Zubeck et al.

(10) Patent No.: US 6,196,187 B1
(45) Date of Patent: Mar. 6, 2001

(54) IDLE AIR BYPASS VALVE SILENCER

(75) Inventors: Michael Wayne Zubeck, Dearborn; Peter Dowding, Bloomfield Hills; Greg Thompson, Dearborn; Michael V. Hofman, Farmington Hills, all of MI (US)

(73) Assignee: Ford Global Technologies, Inc., Dear Born, MI (US)

( * ) Notice: Subject to any disclaimer, the term of this patent is extended or adjusted under 35 U.S.C. 154(b) by 0 days.

(21) Appl. No.: 09/347,733

(22) Filed: Jul. 6, 1999

(51) Int. Cl.[7] ..... F02M 3/00

(52) U.S. Cl. ..... 123/339.1; 123/339.23; 181/253

(58) Field of Search ..... 123/339.1, 339.23, 123/184.21; 181/253, 272, 229

(56) References Cited

U.S. PATENT DOCUMENTS

| | | |
|---|---|---|
| 2,030,391 | 2/1936 | Ott . |
| 3,669,216 | 6/1972 | Spies . |
| 3,712,416 | 1/1973 | Swanson et al. . |
| 4,192,660 | 3/1980 | Ishidera et al. . |
| 5,140,957 | 8/1992 | Walker . |
| 5,174,258 | 12/1992 | Tanaka . |

*Primary Examiner*—Noah P. Kamen
(74) *Attorney, Agent, or Firm*—Ford Global Tech., Inc.

(57) ABSTRACT

A silencer for an idle air bypass valve in an internal combustion engine includes a grid disposed between the outlet of the idle air bypass valve and the intake manifold. The grid acts to reduce the air velocity entering into the intake manifold which dampens the vibration of a plastic manifold, thereby reducing noise generated.

30 Claims, 2 Drawing Sheets

IDLE AIR BYPASS VALVE SILENCER

FIELD OF THE INVENTION

The present invention relates to an apparatus for an idle air bypass valve, and more particularly to an apparatus for reducing noise resulting from air flowing from the idle air bypass valve.

BACKGROUND OF THE INVENTION

Automotive engineers have increasingly utilized plastic materials in developing various engine components, including the intake manifold. Unlike prior aluminum manifolds, which have a high vibration dampening effect, plastic manifolds tend to vibrate more readily as high velocity air flows therethrough resulting in excessive noise.

To reduce such noise, prior art intake systems require elaborate silencing methods which, if incorporated into a modern internal combustion engine, require substantial packaging and/or redesign of the engine. The inventors of the present invention have found that a silencer connected between the outlet of the idle air bypass valve and the intake manifold is sufficient to reduce noise generation in the intake manifold. In addition, the apparatus may be incorporated onto existing engines, thereby allowing for field serviceability.

Copending U.S. patent application, Ser. No. 964,793, assigned to the assignee of the present invention, which is incorporated herein by reference, introduces a housing with a number of perforations to control this noise. Although effective, the plate may increase package space and cost in some applications.

SUMMARY OF THE INVENTION

An object of the present invention is to provide an apparatus for reducing intake air noise at minimal cost and requiring minimal space.

This object is achieved, and disadvantages of prior art approaches overcome, by providing a novel idle air bypass valve silencer for an idle air bypass valve of an automotive internal combustion engine. The engine has an air intake duct, a throttle valve assembly coupled thereto and an intake manifold coupled to the throttle valve assembly and the engine. The idle air bypass valve has an inlet communicating with the air intake duct and an outlet communicating with the intake manifold to selectively bypass the throttle valve assembly. In one particular aspect of the invention, the silencer includes a restrictor plate coupled between the outlet of the bypass valve and the intake manifold. A silencer portion is formed on the restrictor plate, with the silencer portion reducing air velocity flowing from the bypass valve into the intake manifold, thereby reducing noise generated therein.

An advantage of the present invention is that intake air noise is reduced, thereby reducing customer complaints, in a minimal package space and cost.

Another advantage of the present invention is that a low cost apparatus which may be easily mounted to an existing engine is provided.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

$$ update figures & include update to description WRT figures!!!

DETAILED DESCRIPTION OF THE PREFERRED EMBODIMENTS

Figure 1:
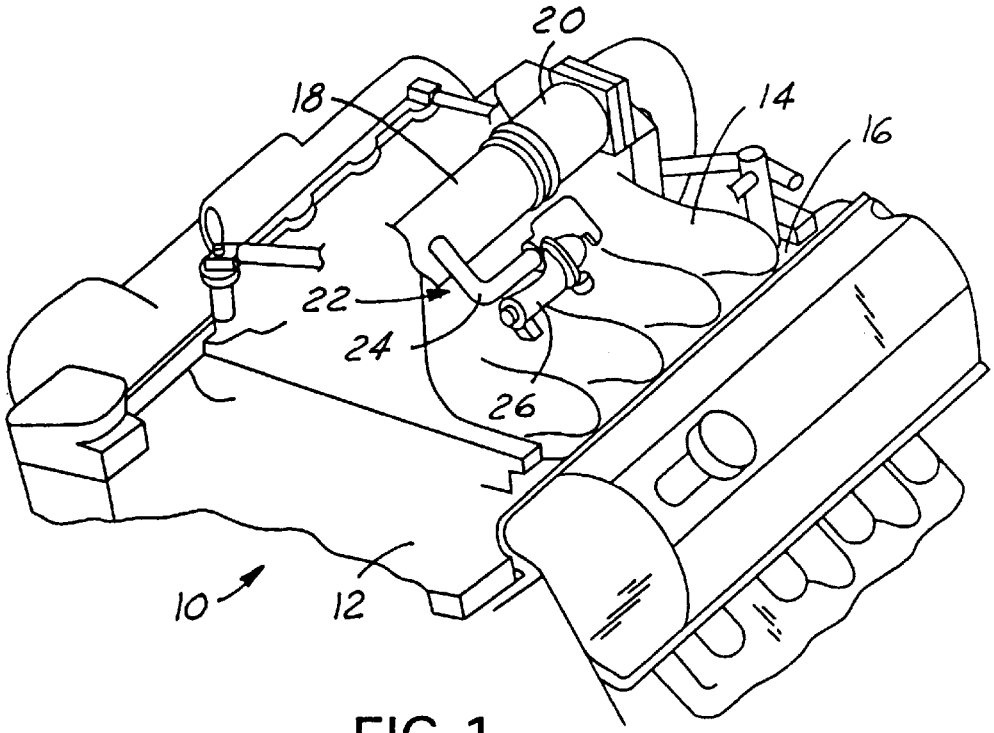
FIG. 1 is a diagrammatic representation of an engine incorporating the idle air bypass valve silencer according to the present invention.

An automotive internal combustion engine 10, as shown in FIG. 1, includes an engine block 12, intake manifold 14 and cylinder head 16 mounted between engine block 12 and manifold 14. Air inlet duct 18 directs outside air to throttle valve assembly 20 into manifold 14. As is well known to those skilled in the art, air is metered by throttle valve assembly 20 such that the engine may operate at a speed proportional to the amount of air flowing past throttle valve assembly 20. Also, as is well known to those skilled in the art, when the engine is at idle, throttle valve assembly 20 is in a closed position.

In order for air to be fed to the engine, idle bypass valve assembly 22 is included. In a preferred embodiment, the bypass valve assembly 22 includes intake hose 24 connected to solenoid valve 26. At engine idle, valve 26 opens to allow air to flow from port 24 through solenoid valve 26 directly into manifold 14, thereby bypassing throttle valve assembly 20. The amount of air flowing through bypass valve assembly 22 corresponds to the desired engine speed at engine idle. According to the present invention, to reduce noise associated with the use of plastic manifolds, a silencer (not shown in FIG. 1) is disposed between the outlet of valve 26 and manifold 14, as will be readily appreciated hereinafter.

A more detailed description of silencer 30 will now be described with reference to FIGS. 2–6. A first embodiment, shown in FIGS. 2–3 comprises a silencer 30 mounted between the valve 26 and manifold 14. As known to one skilled in the art, a housing 15 may be provided between the manifold 14 and valve 26 to route air in a first orifice 17 through the housing 15 and into the valve 26. The air returns through a second orifice 19 in the housing 15 to the intake manifold. A description of such a housing is provided in copending application Ser. No. 08/964,793, assigned to the assignee of the present invention, which is incorporated herein by reference. The housing shown at 30 in the '793 application integrates a silencer having similar principles to the present invention. The present invention provides a separate piece so as to provide a service fix and/or more flexibility in design and implementation. One skilled in the art appreciates the air routing through the solenoid 26 may be accomplished in many manners and the above description is provided as an exemplary routing.

Figure 2:
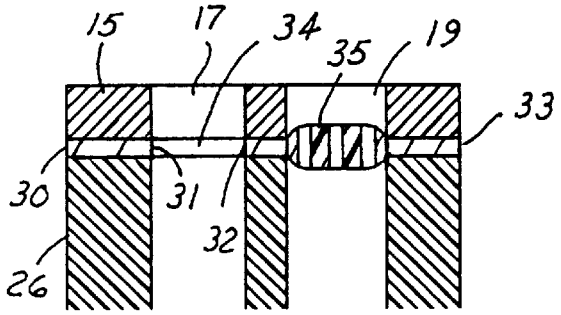
FIG. 2 is a partial cross-sectional view of a idle air bypass valve silencer according to the present invention.
Figure 3A:
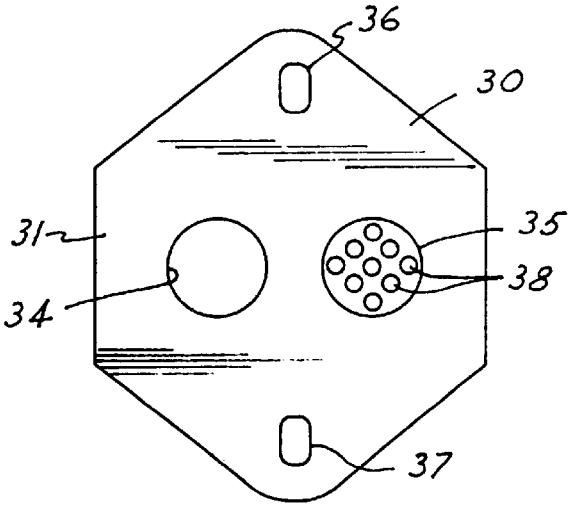
FIGS. 3A and 3B are a plan view and side view, respectively, of the silencer of FIG. 2.
Figure 3B:
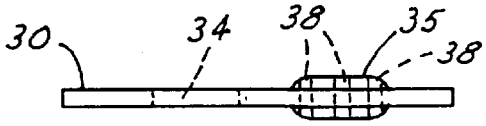

Now referring to FIG. 2, A silencer 30 is provided between the solenoid 26 and housing 15. The housing 15 is then mounted to the intake manifold. Alternatively, with different idle air routing not using the housing 15, the gasket 30 is mounted between the solenoid 26 and intake manifold, or alternatively between the housing 15 and intake manifold. The silencer 30 includes a gasket portion 31, 32, 33, sandwiched between the solenoid 26 and intake manifold to seal between the solenoid and housing 15 (or intake manifold) to prevent air leakage outside the orifices 17, 19. The silencer 30 includes a hole 34 for intake air into the solenoid 26 and a second passage 35 for air from the solenoid 26 to the manifold. A pair of holes 36, 37 are provided for mounting bolts to hold the solenoid 26 to the manifold 14.

The second passage 35 includes a plurality of holes 38 to accommodate the airflow to the intake manifold. As described in the '793 application, the holes 38 throttle the air across the silencer 30. The second passage 35 preferably comprises a plastic material molded to the gasket material 31 so as to provide a simple carrier for holding the silencer between the solenoid 26 and the intake manifold 14 requiring minimal package space and expense, while maximizing the function thereof.

Figure 4A:
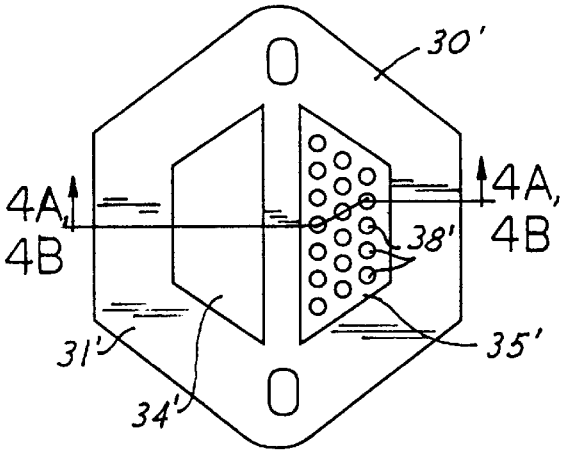
FIGS. 4A, 4B and 4C are a plan view and alternative side views of alternative silencers according to the present invention.
Figure 4B:
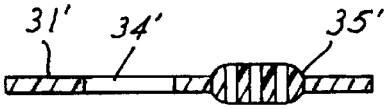
Figure 6:
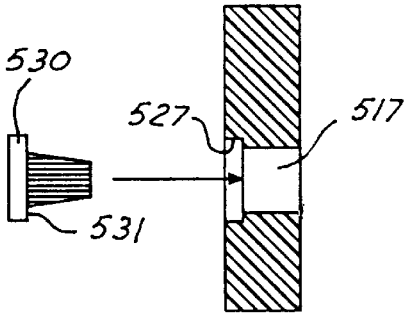
FIG. 6 is a partial cross-sectional view of the silencer of FIG. 5 being inserted into an intake manifold.
Figure 4C:
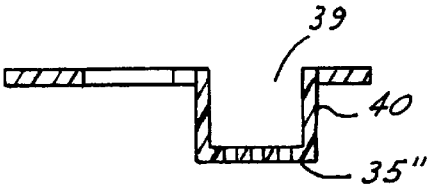

FIG. 4 illustrates an alternative silencer for use in a manner similar to that shown in FIG. 2. Silencer 4A includes a gasket material 31' having an inlet passage 24' and an outlet passage 35'. However, the shape of the passages has been changed to increase the air flow thereacross, especially the outlet passage 35'. As shown in FIG. 4B, the construction is otherwise similar to the silencer of FIGS. 3A–B. FIG. 4C shows a further improvement, including a depression 39 formed in the second passage 35". By providing such a depression 39, the passage 35" is supported by walls 40 to hold the passage 35" inside the intake manifold. This provides for easier tuning of the silencer, since a predetermined volume can thereby be created between the valve and the passage 35".

Figure 5:
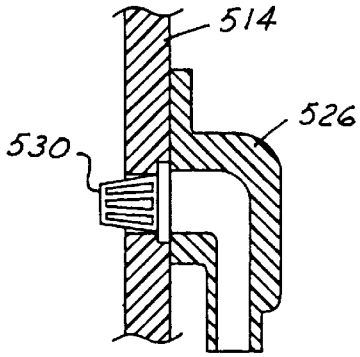
FIG. 5 is a cross-sectional view of a further alternative silencer according to the present invention.
Figure 6A:
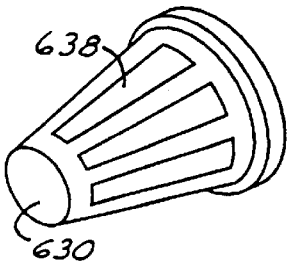
FIGS. 6A–6C comprise perspective views of alternative silencers according t FIG. 5.
Figure 6B:
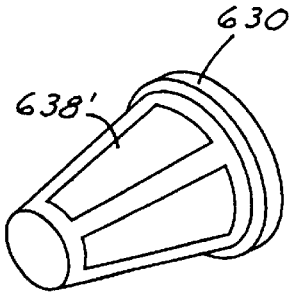
Figure 6C:
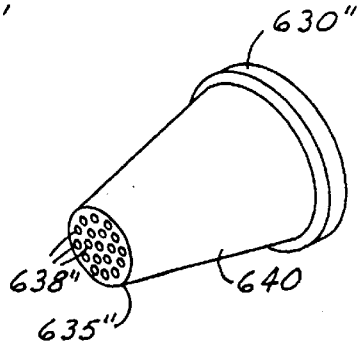

FIG. 5 illustrates yet another alternative embodiment. A substantially cylindrically-shaped silencer 530 is inserted into the intake orifice 517 of the intake manifold 514, downstream of the solenoid 526. Preferably the orifice 517 includes a recess 527 to hold a flange 531 on the silencer 530. As shown in FIGS. 6A–6C, the silencer 630, 630', 630" includes a plurality of apertures 638, 638', 638" to restrict the air flow in a manner similar to that described with reference to the '793 application. The apertures 638, 638', 638" are configured to provide proper air flow and turbulence so as to reduce the noise as the air flows into the manifold as described in the '793 application. As illustrated in FIG. 6C, the silencer 630" may be thimble-shaped and include a side wall 640 to offset the second passage 635" within the intake manifold 514 so as to provide an adequate predetermined volume for effective silencing as described in the '793 application.

The silencers shown here includes a second passage 35 preferably formed of a plastic material. The passage 35 is herein alternatively called a grid plate. As described in the '793 application, a preferred thickness (t) of grid plate 56 is about 7 mm. The volume of the chamber between the valve and the grid plate 35 is sufficient to reduce the velocity of air exiting valve 26 to a predetermined velocity. In addition, the grid plate includes a plurality of equally spaced holes, 38 thereby forming a grid, to allow air to flow from the chamber to the manifold 14 inlet. In a preferred embodiment, the diameter (d) of a hole is about 3 mm, and the center-to-center spacing (s) between holes is about 1.5 mm. Thus, a hole diameter (d) to thickness (t) ratio of about 3:7 is preferable. Such an arrangement creates a turbulence which we have found effective in reducing noise produced by the air entering the manifold. Furthermore, as the air strikes grid plate 35, a portion of the air is reflected back into chamber, which ultimately reduces the air velocity flowing out through holes 38. As described in greater detail in the '793 application, air flowing through holes 38 on grid plate 35 creates a turbulent flow which tends to cancel each other due to the equal spacing(s), described above. This cancellation further reduces noise as air flows from silencer 30.

While the best mode for carrying out the invention has been described in detail, those skilled in the art to which this invention relates will recognize various alternative designs and embodiments, including those mentioned above, in practicing the invention that has been defined by the following claims.

We claim:

1. A silencer for an idle air bypass valve of an automotive internal combustion engine, the engine having an air intake duct, a throttle valve assembly coupled thereto and an intake manifold coupled to the throttle valve assembly and the engine, with the idle air bypass valve having an inlet communicating with the air intake duct and an outlet communicating with the intake manifold to selectively bypass the throttle valve assembly, with the silencer comprising:

a restrictor plate coupled between the outlet of the bypass valve and the intake manifold; and, a silencer portion formed on said restrictor plate, with said silencer portion reducing air velocity flowing from the bypass valve into the intake manifold, thereby reducing noise generated therein.

2. A silencer according to claim 1 wherein said restrictor plate comprises a gasket interposed between the bypass valve and intake manifold, the gasket carrying a grid plate having a plurality of holes formed therein, with said grid plate restricting velocity of air flowing across the grid plate.

3. A silencer according to claim 2, wherein said gasket is compressed in a joint between the bypass valve and intake manifold and the grid plate is supported by the gasket and displaced from the joint into the manifold.

4. A silencer according to claim 2 wherein each said hole has a diameter of about 3 mm.

5. A silencer according to claim 2 wherein said grid plate has a thickness of about 7 mm.

6. A silencer according to claim 1 wherein a center to center spacing of said holes is about 1.5 mm.

7. A silencer according to claim 2 wherein each said hole has a diameter of about 1.5 mm.

8. A silencer according to claim 2 further comprising a chamber disposed upstream of said grid plate, with said chamber having a predetermined volume sufficient to reduce air velocity flowing before the grid plate.

9. A silencer according to claim 1 wherein said restrictor plate comprises a cup-shaped member interposed between the bypass valve and intake manifold, the cup-shaped member carrying a grid plate having a plurality of holes formed therein, with said grid plate restricting velocity of air flowing across the grid plate.

10. A silencer according to claim 9 wherein each said hole has a diameter of about 3 mm.

11. A silencer according to claim 10 wherein said grid plate has a thickness of about 7 mm.

12. A silencer according to claim 10 wherein a center to center spacing of said holes is about 1.5 mm.

13. A silencer according to claim 9 wherein each said hole has a diameter of about 1.5 mm.

14. A silencer according to claim 9 wherein each said hole comprises a slot formed along an axis substantially coincident with a path followed by the airflow into the intake manifold.

15. A silencer according to claim 9 further comprising a chamber disposed upstream of said grid plate, with said chamber having a predetermined volume sufficient to reduce air velocity flowing before the grid plate.

16. A silencer according to claim 9 further comprising a chamber disposed upstream of said grid plate, with said chamber having a predetermined volume sufficient to reduce air velocity flowing before the grid plate.

17. A silencer for an idle air bypass valve of an automotive internal combustion engine, the engine having an air intake duct, a throttle valve assembly coupled thereto and an intake manifold coupled to the throttle valve assembly and the engine, with the idle air bypass valve having an inlet communicating with the air intake duct and an outlet communicating with the intake manifold to selectively bypass the throttle valve assembly, with the silencer comprising:

a restrictor plate adapted to be mounted to one of the bypass valve and the intake manifold;

a grid plate formed on said restrictor plate, with said grid plate provided to obstruct the flow of air into the intake manifold, with said grid plate comprising a plurality of holes formed therein, with said grid plate restricting velocity of air flowing before the restrictor plate, thereby reducing noise generated in the intake manifold.

18. A silencer according to claim 17 wherein each said hole has a diameter of about 3 mm.

19. A silencer according to claim 18 wherein said grid plate has a thickness of about 7 mm.

20. A silencer according to claim 19 wherein a center to center spacing of said holes is about 1.5 mm.

21. A silencer according to claim 17 wherein said outlet chamber and said grid plate define a predetermined volume of space sufficient to reduce air velocity flowing from the outlet of the bypass valve.

22. A silencer according to claim 21 wherein said restrictor plate comprises a gasket interposed between the bypass valve and intake manifold, the gasket carrying a grid plate having a plurality of holes formed therein, with said grid plate restricting velocity of air flowing across the grid plate.

23. A silencer according to claim 21 wherein said restrictor plate comprises a cup-shaped member interposed between the bypass valve and intake manifold, the cup-shaped member carrying a grid plate having a plurality of holes formed therein, with said grid plate restricting velocity of air flowing across the grid plate.

24. A silencer according to claim 23 wherein each said hole comprises a slot formed along an axis substantially coincident with a path followed by the airflow into the intake manifold.

25. An idle air bypass assembly for an automotive internal combustion engine, the engine having an air intake duct, a throttle valve assembly coupled thereto and an intake manifold coupled to the throttle valve assembly and the engine, with the idle air bypass assembly comprising:

a solenoid actuated idle air bypass valve having an inlet and an outlet, with said inlet adapted to communicate with the air intake duct and with said outlet adapted to communicate with the intake manifold to bypass the throttle valve assembly;

a silencer coupled to said idle air bypass valve and adapted to be mounted to the intake manifold, with said silencer comprising:

a restrictor plate coupled between the outlet of the bypass valve and the intake manifold; and, a silencer portion formed on said restrictor plate, with said silencer portion including a grid plate comprising a plurality of holes formed therein for reducing air velocity flowing from the bypass valve into the intake manifold, thereby reducing noise generated therein.

26. A silencer according to claim 25 wherein said restrictor plate comprises a gasket interposed between the bypass valve and intake manifold, the gasket carrying a grid plate having a plurality of holes formed therein, with said grid plate restricting velocity of air flowing across the grid plate.

27. A silencer according to claim 26, wherein said gasket is compressed in a joint between the bypass valve and intake manifold and the grid plate is supported by the gasket and displaced from the joint into the manifold.

28. A silencer according to claim 25 wherein said restrictor plate comprises a cup-shaped member interposed between the bypass valve and intake manifold, the cup-shaped member carrying a grid plate having a plurality of holes formed therein, with said grid plate restricting velocity of air flowing across the grid plate.

29. An idle air bypass assembly according to claim 25 wherein each said hole has a diameter of about 3 mm and said grid plate has a thickness of about 7 mm.

30. A silencer according to claim 25 wherein said outlet chamber and said grid plate define a predetermined volume of space sufficient to reduce air velocity flowing from the outlet of the bypass valve.

* * * * *